US008886538B2

(12) United States Patent
Aaron et al.

(10) Patent No.: US 8,886,538 B2
(45) Date of Patent: Nov. 11, 2014

(54) SYSTEMS AND METHODS FOR TEXT-TO-SPEECH SYNTHESIS USING SPOKEN EXAMPLE

(75) Inventors: Andy Aaron, Ardsley, NY (US); Raimo Bakis, Briarcliff Manor, NY (US); Ellen M. Eide, Bedford Hills, NY (US); Wael M. Hamza, Tarrytown, NY (US)

(73) Assignee: Nuance Communications, Inc., Burlington, MA (US)

( * ) Notice: Subject to any disclaimer, the term of this patent is extended or adjusted under 35 U.S.C. 154(b) by 2003 days.

(21) Appl. No.: 10/672,374

(22) Filed: Sep. 26, 2003

(65) Prior Publication Data

US 2005/0071163 A1 Mar. 31, 2005

(51) Int. Cl.
*G10L 13/08* (2013.01)
*G10L 13/10* (2013.01)

(52) U.S. Cl.
CPC ..... *G10L 13/10* (2013.01)
USPC ..... 704/260; 704/268; 704/E13.011; 704/E13.013

(58) Field of Classification Search
CPC ..... G10L 13/02; G10L 13/07; G10L 13/08; G10L 13/043; G10L 13/00; G10L 13/027; G10L 15/02; G10L 15/1807
USPC ..... 704/260, 266, 268, 270, E13.011, 704/E13.013
See application file for complete search history.

(56) References Cited

U.S. PATENT DOCUMENTS

| | | | | |
|---|---|---|---|---|
| 5,652,828 | A * | 7/1997 | Silverman | 704/260 |
| 5,668,926 | A * | 9/1997 | Karaali et al. | 704/232 |
| 5,860,064 | A * | 1/1999 | Henton | 704/260 |
| 6,035,271 | A | 3/2000 | Chen | |
| 6,081,780 | A * | 6/2000 | Lumelsky | 704/260 |
| 6,101,470 | A * | 8/2000 | Eide et al. | 704/260 |
| 6,446,040 | B1 * | 9/2002 | Socher et al. | 704/260 |
| 6,810,378 | B2 * | 10/2004 | Kochanski et al. | 704/258 |
| 6,865,533 | B2 * | 3/2005 | Addison et al. | 704/260 |
| 7,401,020 | B2 | 7/2008 | Eide | |
| 2002/0120450 | A1 * | 8/2002 | Junqua et al. | 704/258 |
| 2004/0073428 | A1 * | 4/2004 | Zlokarnik et al. | 704/260 |

OTHER PUBLICATIONS

Saon et al, "Maximum Likelihood Discriminant Feature Spaces," 2000, IEEE International Conference on Acoustics, Speech, and Signal Processing, vol. 2, Jun. 5-9, 2000, pp. 1129-1132.*
Forney, "The Viterbi Algorithm" Proc. IEEE, v. 61, pp. 268-278, 1973.

* cited by examiner

*Primary Examiner* — Angela A Armstrong
(74) *Attorney, Agent, or Firm* — Wolf, Greenfield & Sacks, P.C.

(57) ABSTRACT

Systems and methods for speech synthesis and, in particular, text-to-speech systems and methods for converting a text input to a synthetic waveform by processing prosodic and phonetic content of a spoken example of the text input to accurately mimic the input speech style and pronunciation. Systems and methods provide an interface to a TTS system to allow a user to input a text string and a spoken utterance of the text string, extract prosodic parameters from the spoken input, and process the prosodic parameters to derive corresponding markup for the text input to enable a more natural sounding synthesized speech.

22 Claims, 3 Drawing Sheets

22
text
audio in
acoustic feature extraction
30
alignment
32
durations
pitch contour extraction
31
pitch contour
Conversion of low-level parameters to markup
33
marked up text 40
41
42
43
44
45
46
47
type your text here
record
STOP

SYSTEMS AND METHODS FOR TEXT-TO-SPEECH SYNTHESIS USING SPOKEN EXAMPLE

TECHNICAL FIELD OF THE INVENTION

The present invention relates generally to systems and method for speech synthesis and, more particularly, text-to-speech systems and methods for converting a text input to a synthetic waveform by processing prosodic and phonetic content of a spoken example of the text input to accurately mimic the style and pronunciation of the spoken input.

BACKGROUND

In general, a text-to-speech (TTS) system can convert input text into an acoustic waveform that is recognizable as speech corresponding to the input text. More specifically, speech generation involves, for example, transforming a string of phonetic and prosodic symbols into a synthetic speech signal. It is desirable for a TTS system to provide synthesized speech that is intelligible, as well as synthesized speech that sounds natural.

To synthesize natural-sounding speech, it is essential to control prosody. Prosody refers to the set of speech attributes which do not alter the segmental identity of speech segments, but rather affect the quality of the speech. An example of a prosodic element is lexical stress. The lexical stress pattern within a word plays a key role in determining the manner in which the word is synthesized, as stress in natural speech is typically realized physically by an increase in pitch and phoneme duration. Thus, acoustic attributes such a pitch and segmental duration patterns provide important information regarding prosodic structure. Therefore, modeling them greatly improves the naturalness of synthetic speech.

Some conventional TTS systems operate on a pure text input and produce a corresponding speech output with little or no preprocessing or analysis of the received text to provide pitch information for synthesizing speech. Instead, such systems use flat pitch contours corresponding to a constant value of pitch, and consequently, the resulting speech waveforms sound unnatural and monotone.

Other conventional TTS systems are more sophisticated and can process text input to determine various attributes of the text which can influence the pronunciation of the text. The attributes enable the TTS system to customize the spoken outputs and/or produce more natural and human-like pronunciation of text inputs. The attributes can include, for example, semantic and syntactic information relating to a text input, stress, pitch, gender, speed, and volume parameters that are used for producing a spoken output. Other attributes can include information relating to the syllabic makeup or grammatical structure of a text input or the particular phonemes used to construct the spoken output.

Furthermore, other conventional TTS systems process annotated text inputs wherein the annotations specify pronunciation information used by the TTS to produce more fluent and human-like speech. By way of example, some TTS systems allow the user to specify "marked-up" text, or text accompanied by a set of controls or parameters to be interpreted by the TTS engine.

FIG. 1 is a diagram that illustrates a conventional system for providing text-to-speech synthesis. The system (10) comprises a user interface (11) that allows a user to manually generate marked-up text that describes the manner in which text is to be synthesized based on, e.g., pronunciation, volume, pitch, and rate attributes, etc.

For example, for a text input such as "Welcome to the IBM text-to-speech system", a marked-up version of the text can be, for example: "\prosody<rate=fast> Welcome to the \emphasis IBM text-to-speech system", which instructs the synthesizer to produce fast speech, with emphasis on "IBM." The marked-up text is processed by a TTS engine (12) that is capable of parsing and processing the marked-up text to generate a synthetic waveform in accordance with the markup specifications, using methods known to those of ordinary skill in the art. The TTS engine (12) can output the synthesized text to a loudspeaker (13).

The process of manually generating marked-up text for TTS can be very burdensome. Indeed, in order to achieve a desired effect, the user will typically use trial-and-error to generate the desired marked-up text. Furthermore, although the conventional system (10) of FIG. 1 affords the user a certain degree of freedom for controlling the output speech, it is extremely difficult and tedious to achieve fine control of the pitch or duration using such method. For example, the user would have to hypothesize a set of pitches and durations for each sound, test the output to see how closely he/she achieved the desired effect, and then iterate the process until the speech generated by the TTS system matched the prosodic characteristics desired by the user.

SUMMARY OF THE INVENTION

Exemplary embodiments of the present invention include systems and methods for speech synthesis and, more particularly, text-to-speech systems and methods for converting a text input to a synthetic waveform by processing prosodic and phonetic content of a spoken example of the text input to accurately mimic the style and pronunciation of the spoken input.

In one exemplary embodiment of the invention, a method for speech synthesis includes determining prosodic parameters of a spoken utterance, automatically generating a marked-up text corresponding to the spoken utterance using the prosodic parameters, and generating a synthetic waveform using the marked-up text. The prosodic parameters include, for example, pitch contour, duration contour and/or energy contour information of the spoken utterance.

In another exemplary embodiment of the invention, the method includes processing phonetic content of the spoken utterance to generate the synthetic waveform having a desired pronunciation.

In yet another exemplary embodiment of the invention, a process of automatically generating a marked-up text includes directly specifying the prosodic parameters as attribute values for mark-up elements. For example, in one exemplary embodiment in which SSML (Speech Synthesis Markup Language) is used for describing the TTS specifications, attributes of a "prosody" element such as pitch, contour, range, rate, duration, etc., can be specified directly from the extracted prosodic content of the spoken utterance.

In another exemplary embodiment of the invention, automatic generation of marked-up text includes assigning abstract labels to the prosodic parameters to generate a high-level markup.

In another exemplary embodiment of the invention, a text-to-speech (TTS) system comprises a prosody analyzer for determining prosodic parameters of a spoken utterance and automatically generating a marked-up text corresponding to the spoken utterance using the prosodic parameters, and a TTS system for generating a synthetic waveform using the marked-up text. Furthermore, in one exemplary embodiment, the system further includes a user interface that enables a user to input the spoken utterance and input a text string corresponding to the spoken utterance.

In yet another embodiment of the invention, the prosody analyzer of the TTS system includes a pitch contour extraction module for determining pitch contour information for the spoken utterance, an alignment module for aligning the input text string with the spoken utterance to determine duration contour information of elements comprising the input text string, and a conversion module for including markup in the input text string in accordance with the duration and pitch contour information to generate the marked up text.

These and other exemplary embodiments, aspects, features and advantages of the present invention will be described and become apparent from the following detailed description of exemplary embodiments, which is to be read in connection with the accompanying drawings.

DETAILED DESCRIPTION OF EXEMPLARY EMBODIMENTS

Exemplary embodiments of the present invention include systems and methods for speech synthesis and, in particular, text-to-speech systems and methods for converting a text input to a synthetic waveform by processing prosodic and phonetic content of a spoken example of the text input to accurately mimic the style and pronunciation of the spoken input. Furthermore, exemplary embodiments of the present invention include systems and methods for interfacing with a TTS system to allow a user to input a text string and a corresponding spoken utterance of the text string, as well as systems and methods for extracting prosodic parameters and pronunciations from the spoken input, and processing the prosodic parameters to automatically generate corresponding markup for the text input, to thereby generate a more natural sounding synthesized speech.

It is to be understood that the systems and methods described herein may be implemented in various forms of hardware, software, firmware, special purpose processors, or a combination thereof. In particular, the present invention is preferably implemented as an application comprising program instructions that are tangibly embodied on one or more program storage devices (e.g., hard disk, magnetic floppy disk, RAM, ROM, CD ROM, etc.) and executable by any device or machine comprising suitable architecture. It is to be further understood that, because some of the constituent system components and process steps depicted in the accompanying Figures are preferably implemented in software, the connections between system modules (or the logic flow of method steps) may differ depending upon the manner in which the present invention is programmed. Given the teachings herein, one of ordinary skill in the related art will be able to contemplate these and similar implementations or configurations of the present invention.

Figure 1:
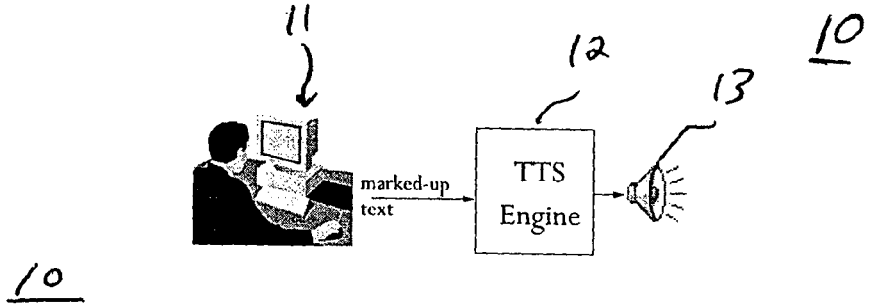
Fig. 1 (Prior Art)
FIG. 1 is a diagram illustrating a conventional text-to-speech system.
Figure 2:
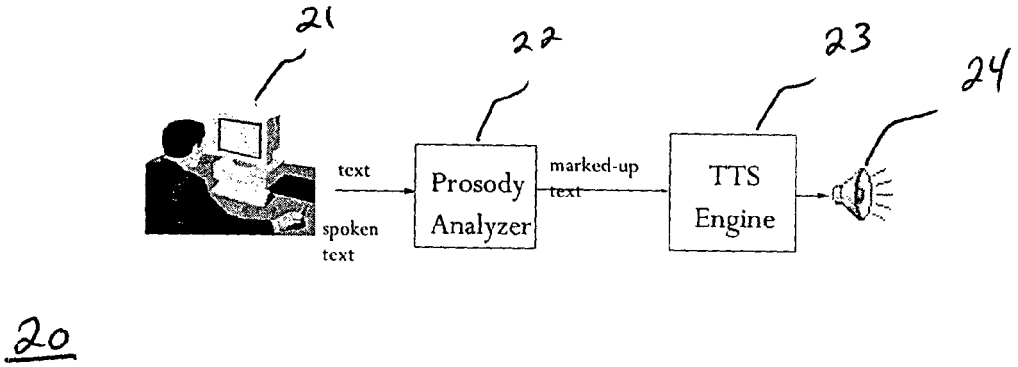
FIG. 2 is a diagram illustrating a text-to-speech system according to an exemplary embodiment of the invention.

Referring now to FIG. 2, a block diagram illustrates a system for providing text-to speech synthesis according to an exemplary embodiment of the present invention. In general, the system (20) comprises a user interface (21), a prosody analyzer (22), a text-to-speech engine (23) and an audio output device (24) (e.g., speaker).

Figure 4:
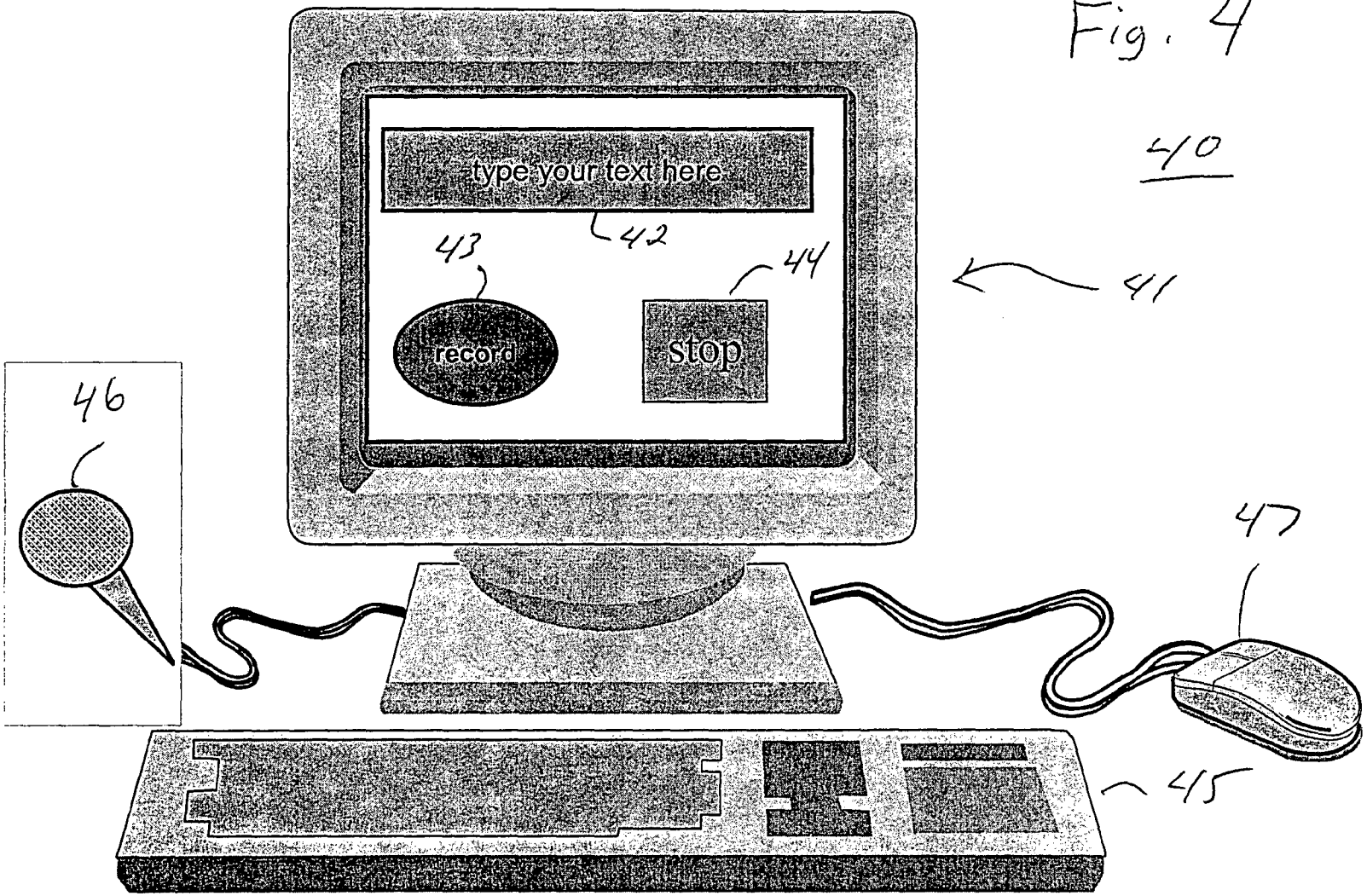
FIG. 4 is a diagram illustrating a graphical user interface for a TTS system according to an exemplary embodiment of the invention.

The user interface (21) allows a user to input a text string and then utter the text string to provide an audio example of the input text string (which is recorded by the system). By way of example, FIG. 4 is a diagram that illustrates an exemplary embodiment of a user interface according to the invention. As depicted in FIG. 4, an exemplary user interface (40) comprises a GUI (41) (graphical user interface) that can be displayed on a display of a PC (personal computer) or workstation. The GUI (41) comprises an input field (42) that allows a user to input a text string via a keyboard (45), for example. The GUI (41) further comprises a "record button" (43) and a "stop button" (44), which can be selected via a pointing device (47) such as a mouse. The record button (43) can be clicked to commence recording a spoken example that the user inputs via a microphone (46).

For example, the user could input the text string "Welcome to the IBM text-to-speech system" in the text input field (42) and then click on the record button (43) to start recording as the user recites the same text string into the microphone in the manner in which the user wants the system to reproduce the synthesized speech. When the input utterance is complete, the user can click on the stop button (44) to stop the recording process.

It is to be understood that the user interface (40) of FIG. 4 is merely exemplary, and that the system (20) of FIG. 2 can be configured for processing speech commands in addition to, or in lieu of, GUI commands. For instance, the user could speak to the system (20) by saying "The way I want the input text spoken is as follows: Welcome to the IBM text-to-speech system."

Referring again to FIG. 2, in general, the prosody analyzer (22) receives and processes the text input and corresponding spoken input to generate meta information that is used by the TTS synthesis engine (23) to generate a synthetic waveform of the text input. More specifically, in one exemplary embodiment, the spoken input is analyzed by the prosody analyzer (22) to extract prosodic content (prosodic parameters) including a detailed set of pitch, duration, and energy values. The prosodic parameters (e.g., resulting pitch, duration, and energy contours) are further processed to generate marked-up text that is used to drive a markup-enabled TTS Engine (23). In other words, the prosodic parameters are automatically translated into markup. The TTS engine (23) produces a natural sounding synthesized speech in accordance with the prosodic contours that are specified by markup in the marked-up text. The synthesized speech can be output via the speaker (24) for user confirmation, and then saved to a file if the synthesized waveform is acceptable to the user.

Advantageously, the exemplary system (20) provides mechanisms for analyzing the prosodic content of the spoken example and processing the resulting pitch, duration (timing), and energy contours, to thereby mimic the input speech style, but spoken by the voice of the synthesizer. One exemplary advantage of the exemplary system (20) lies in the user interface (21) in that a developer (e.g., developer of an IVR (interactive voice response system)) does not require knowledge of the technical details regarding speech such as how the pitch should vary to achieve a desired effect nor knowledge for authoring marked-up text. Rather, the developer need only provide an audio direction to the system which would be dutifully reproduced in the synthesis output.

Figure 3:
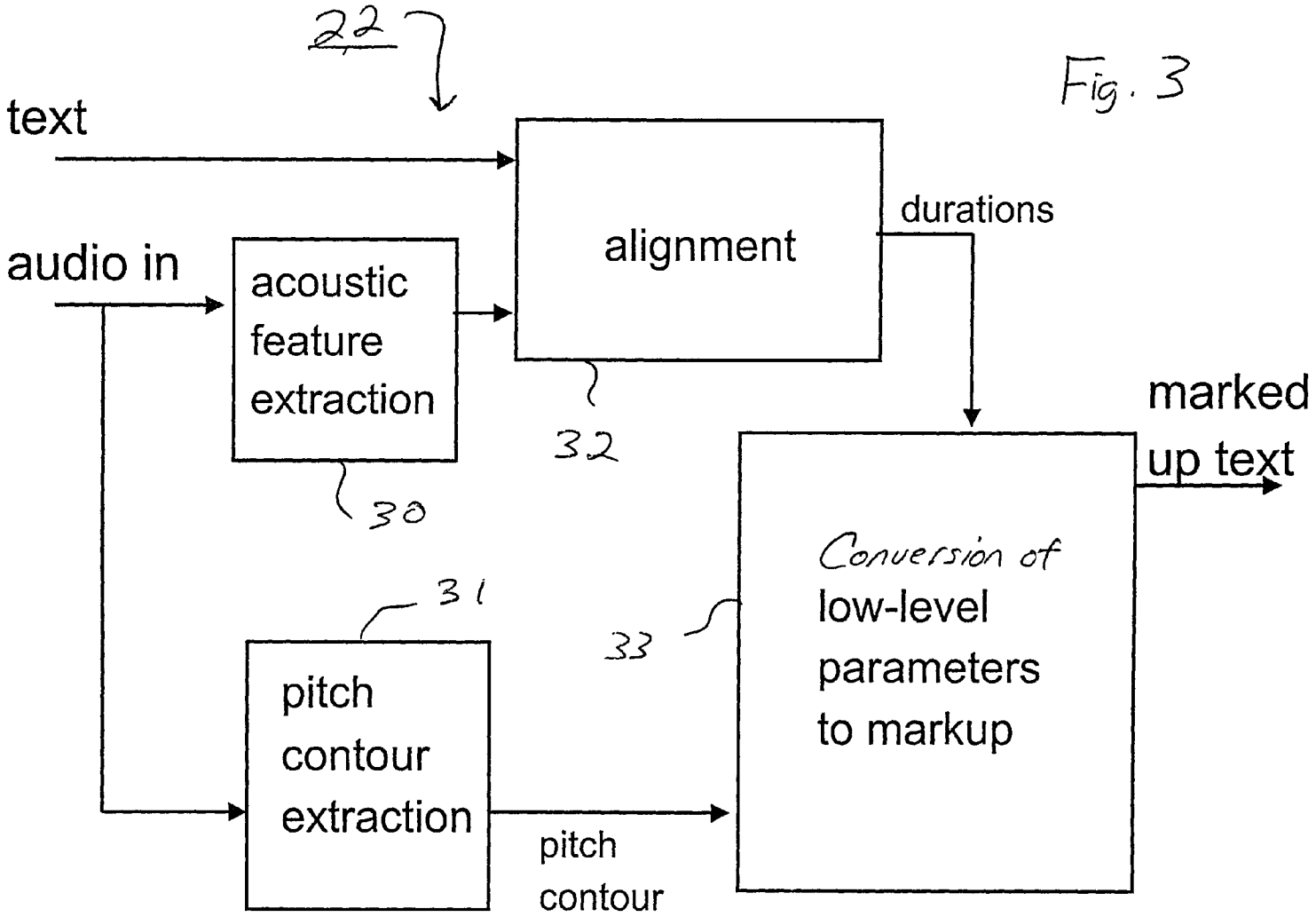
FIG. 3 is a diagram illustrating a system/method for analyzing prosodic content of a spoken example

FIG. 3 is a block diagram illustrating a prosody analyzer according to an exemplary embodiment of the invention, which can be implemented in the system (20) of FIG. 2. More specifically, FIG. 3 illustrates components or modules of a prosody analyzer according to an exemplary embodiment of the invention. It is to be understood that FIG. 3 further depicts a flow diagram of a method for processing text and audio input to extract prosody content and generate marked up text, according to one aspect of the invention. As depicted in FIG. 3, the prosody analyzer (22) comprises a feature extraction module (30), a pitch contour extraction module (31), an alignment module (32) and a conversion module (33).

More specifically, the prosody analyzer (22) receives as input a text string and corresponding audio input (spoken example) from the user interface system. The audio input is processed by the feature extraction module (30) to extract relevant feature data from the acoustic signal using methods well known to those skilled in the art of automatic speech recognition. By way of example, the acoustic feature extraction module (30) receives and digitizes the input speech waveform (spoken utterance), and transforms the digitized input waveforms into a set of feature vectors on a frame-by-frame basis using feature extraction techniques known by those skilled in the art. In one exemplary embodiment, the feature extraction process involves computing spectral or cepstral components and corresponding dynamics such as first and second derivatives. The feature extraction module (30) may produce a 24-dimensional cepstra feature vector for every 10 ms of the input waveform, splicing nine frames together (i.e., concatenating the four frames to the left and four frames to the right of the current frame) to augment the current vector of cepstra, and then reduce each augmented cepstral vector to a 60-dimensional feature vector using linear discriminant analysis. The input (original) waveform feature vectors can be stored and then accessed for subsequent processing.

The alignment module (32) receives as input the text string and the acoustic feature data of the corresponding audio input, and then performs an automatic alignment of the speech to the text, using standard techniques in speech analysis. The output of the alignment module (32) comprises a set of time markings, indicating the durations of each of the units (such as words and phonemes) which make up the text. More specifically, in one exemplary embodiment of the invention, the alignment module (32) will segment an input speech waveform into phonemes, mapping time-segmented regions to corresponding phonemes.

In yet another exemplary embodiment, the alignment module (32) allows for multiple pronunciations of words, wherein the alignment module (32) can simultaneously determine a text-to-phoneme mapping of the spoken example and a time alignment of the audio to the resulting phonemes for different pronunciations of a word. For example, if the input text is "either" and the system synthesizes the word with a pronunciation of [ay-ther], the user can utter the spoken example with the pronunciation [ee-ther], and the system will be able to synthesize the text using the desired pronunciation.

In one exemplary embodiment, alignment is performed using the well-known Viterbi algorithm as disclosed, for example, in "The Viterbi Algorithm," by G. D. Formey, Jr., Proc. IEEE, vol. 61, pp. 268-278, 1973. In particular, as is understood by those skilled in the art, the Viterbi alignment finds the most likely sequence of states given the acoustic observations, where each state is a sub-phonetic unit and the probability density function of the observations is modeled as a mixture of 60-dimensional Gaussians. It is to be appreciated that by time-aligning the audio input to the input text sequence at the phoneme level, the audio input waveform may be segmented into contiguous time regions, with each region mapping to one phoneme in the phonetic expansion of the text sequence (i.e., a segmentation of each waveform into phonemes). As noted above, the output of the alignment module (32) comprises a set of time markings, indicating the durations of each of the units (such as words and phonemes) which make up the text.

In the exemplary embodiment of FIG. 3, the audio input is also processed by the pitch contour extraction module (31) to analyze and extract parameters associated with pitch contour in the spoken input. The pitch contour extraction module (31) may implement any suitable, standard technique for analyzing the pitch of a speech segment as in known in the art. For example, the methods disclosed in U.S. Pat. No. 6,101,470, to Eide, et al., entitled: "Methods For Generating Pitch And Duration Contours In A Text To Speech System," which is commonly assigned and incorporated herein by reference, can be used for extracting pitch contours from an acoustic waveform. In addition, the methods disclosed in U.S. Pat. No. 6,035,271 to Chen, entitled "Statistical Methods and Apparatus for Pitch Extraction In Speech Recognition, Synthesis and Regeneration", which is commonly assigned and incorporated herein, may also be implemented extracting pitch contours from an acoustic waveform.

The conversion module (33) receives as input the duration contours from the alignment module (32) and the pitch contours from the pitch contour extraction module (31) and processes the pitch and duration contours to generate corresponding TTS markup for the input text, as specified based on the markup descriptions. Both the pitch and duration contours are specified in terms of time from the beginning of the words, which enables alignment/mapping of such information in the conversion module (33).

In one exemplary embodiment, the resulting text comprises low-level markup, wherein relevant prosodic parameters are directly incorporated in the marked-up text. More specifically, by way of example, in one exemplary embodiment of the invention, the TTS markup generated by the conversion module can be defined used Speech Synthesis Markup Language" (SSML). SSML is a proposed specification being developed via the World Wide Web Consortium" (W3C), which can be implemented to control the speech synthesizer. The SSML specification defines XML (Extensible Markup Language) elements for describing how elements of a text string are to be pronounced. For example, SSML defines a "prosody" element to control the pitch, speaking rate and volume of speech output. Attributes of the "prosody" element include (i)pitch: to specify a baseline pitch (frequency value) for the contained text (ii) contour: to set the actual pitch contour for the contained text (iii) range: to specify the pitch range for the contained text; (iv) rate: to specify the speaking rate in words-per-minute for the contained text; (v) duration: to specify a value in seconds or millisecond for the desired time to take to read the element contents; and (vi) volume: to specify the volume for the contained text.

Accordingly, in an exemplary embodiment in which the conversion module (33) generates SSML markup, for example, one or more values for the above attributes of the prosody element can be directly obtained from the extracted prosody information. It is to be understood that SSML is just one example of a TTS markup that can be implemented, and that the present invention can be implemented using any suitable TTS markup definition, whether such definition is based on a standard or proprietary.

It is to be appreciated that in another exemplary embodiment of the invention, the low-level pitch and duration contours can be analyzed and assigned an abstract label, such as "enthusiastic" or "apologetic", to generate a high-level marked-up text that is passed to a TTS engine capable of interpreting such markup. For example, systems and methods for implementing expressive (high-level) markup can be implemented in the conversion module (33) using the techniques described in U.S. patent application Ser. No. 10/306,950, filed on Nov. 29, 2002, entitled "Application of Emotion-Based Intonation and Prosody to Speech in Text-to-Speech Systems", which is commonly assigned and incorporated herein by reference. This application describes, for example, methods for mapping high-level markup with low level parameters using style sheets for different speakers.

The marked up text is output from the prosody analyzer (22) to the TTS synthesizer engine (23) (FIG. 2), wherein a synthetic waveform is generated based on the marked-up text. It is to be appreciated that any system or method that is configured for synthesizing speech from marked-up text may be implemented in the present invention. In general, speech synthesis of marked up text comprises parsing a marked-up text string or document to determine the content and structure of the text, converting the text to a string of phonemes, performing prosody analysis as declaratively described via the relevant markup elements and attributes, and generating a waveform using the phonemes and prosodic information.

Although exemplary embodiments have been described herein with reference to the accompanying drawings, it is to be understood that the present system and method is not limited to those precise embodiments, and that various other changes and modifications may be affected therein by one skilled in the art without departing from the scope or spirit of the invention. All such changes and modifications are intended to be included within the scope of the invention as defined by the appended claims.

What is claimed is:

1. An article of manufacture comprising a program storage device readable by a machine, tangibly embodying a program of instructions executable by the machine to perform a method for speech synthesis that allows user specified pronunciations, the method comprising:

providing a user interface that allows a user to identify a text string for synthesis and to speak a pronunciation of the text string;

recording the user's spoken pronunciation of the text string as an audio signal;

extracting prosodic parameter values from the audio signal corresponding to the user's pronunciation of the text string, wherein extracting the prosodic parameter values comprises extracting duration parameter values from the audio signal by aligning the audio signal with the text string;

automatically translating at least a portion of the prosodic parameter values extracted at least in part by aligning the audio signal of the user's spoken pronunciation with the text string into abstract labels to generate a high-level markup of the text string; and generating a synthetic speech waveform by applying a markup-enabled text-to-speech engine to the text string with the high-level markup.

2. The article of manufacture of claim 1, wherein the extracting duration parameter values by aligning comprises segmenting the audio signal into time-segmented regions, wherein each time-segmented region is mapped to a corresponding phoneme.

3. The article of manufacture of claim 1, wherein the extracting duration parameter values by aligning comprises using a Viterbi alignment process.

4. The article of manufacture of claim 1, wherein the method further comprises directly specifying at least one portion of the prosodic parameter values as attribute values for mark-up elements.

5. The article of manufacture of claim 1, wherein the translating comprises generating the markup of the text string using SSML (speech synthesis markup language).

6. The article of manufacture of claim 1, further comprising instructions for processing phonetic content of the audio signal to generate the synthetic speech waveform having a desired pronunciation.

7. The article of manufacture of claim 1, wherein the method further comprises extracting acoustic feature data from the audio signal and wherein the aligning further comprises outputting one or more duration contours.

8. The article of manufacture of claim 7, wherein extracting acoustic feature data from the audio signal comprises digitizing the audio signal into a set of frames and transforming the digitized audio signal into a set of feature vectors on a frame-by-frame basis.

9. The article of manufacture of claim 1, wherein the method further comprises directly specifying at least one portion of the extracted prosodic parameter values as prosodic parameter values for synthesis of the synthetic speech waveform representing the text string.

10. A text-to-speech (TTS) system that allows user specified pronunciations, the system comprising:

at least one processor; and at least one storage device storing processor-executable instructions that, when executed by the at least one processor, perform a method comprising:

providing a user interface that allows a user to identify a text string for synthesis and to speak a pronunciation of the text string;

recording the user's spoken pronunciation of the text string as an audio signal;

extracting prosodic parameter values from the audio signal corresponding to the user's pronunciation of the text string, wherein extracting the prosodic parameter values comprises extracting duration parameter values from the audio signal by aligning the audio signal with the text string;

automatically translating at least a portion of the prosodic parameter values extracted at least in part by aligning the audio signal of the user's spoken pronunciation with the text string into abstract labels to generate a high-level markup of the text string; and generating a synthetic speech waveform by applying a markup-enabled text-to-speech engine to the text string with the high-level markup.

11. The article of manufacture of claim 8, wherein transforming the digitized audio signal comprises producing a 24-dimensional cepstra feature vector for every 10 ms of the audio signal, concatenating frames to the left and to the right of a current frame to augment a current cepstral vector, and reducing each augmented cepstral vector to a 60-dimensional feature vector using linear discriminant analysis.

12. The system of claim 10, wherein the method further comprises extracting acoustic feature data from the audio signal, and wherein the aligning comprises outputting one or more duration contours.

13. A method for speech synthesis that allows user specified pronunciations, the method comprising:

providing a user interface that allows a user to identify a text string for synthesis and to speak a pronunciation of the text string;

recording the user's spoken pronunciation of the text string as an audio signal;

extracting prosodic parameter values from the audio signal corresponding to the user's pronunciation of the text string, wherein extracting the prosodic parameter values comprises extracting duration parameter values from the audio signal by aligning the audio signal with the text string;

automatically translating at least a portion of the prosodic parameter values extracted at least in part by aligning the audio signal of the user's spoken pronunciation with the text string into abstract labels to generate a high-level markup of the text string; and generating a synthetic speech waveform by applying a markup-enabled text-to-speech engine to the text string with the high-level markup.

14. The method of claim 13, wherein the aligning comprises extracting acoustic feature data from the audio signal and time-aligning the audio signal to the text string using the acoustic feature data.

15. The method of claim 13, wherein the aligning is performed using a Viterbi alignment process.

16. The method of claim 13, further comprising directly specifying at least one portion of the prosodic parameter values as attribute values for mark-up elements.

17. The method of claim 13, wherein the translating comprises generating the markup of the text string using SSML (speech synthesis markup language).

18. The method of claim 13, further comprising processing phonetic content of the audio signal to generate the synthetic speech waveform having a desired pronunciation.

19. The method of claim 13, wherein the aligning further comprises outputting one or more duration contours.

20. The method of claim 13, further comprising extracting acoustic feature data from the audio signal, including digitizing the audio signal into a set of frames and transforming the digitized audio signal into a set of feature vectors on a frame-by-frame basis.

21. The method of claim 20, wherein transforming the digitized audio signal comprises producing a 24-dimensional cepstra feature vector for every 10 ms of the audio signal, concatenating frames to the left and to the right of a current frame to augment a current cepstral vector, and reducing each augmented cepstral vector to a 60-dimensional feature vector using linear discriminant analysis.

22. The method of claim 13, further comprising directly specifying at least one portion of the extracted prosodic parameter values as prosodic parameter values for synthesis of the synthetic speech waveform representing the text string.

* * * * *